US006389633B1

(12) United States Patent
Rosen

(10) Patent No.: US 6,389,633 B1
(45) Date of Patent: May 21, 2002

(54) LOW COST BRUSHING BEHAVIOR REINFORCEMENT TOOTHBRUSH

(76) Inventor: Howard Rosen, 5756 Royalmount Avenue, Montreal, Quebec (CA), H4P 1K5

( * ) Notice: Subject to any disclaimer, the term of this patent is extended or adjusted under 35 U.S.C. 154(b) by 0 days.

(21) Appl. No.: 09/456,463

(22) Filed: Dec. 8, 1999

(51) Int. Cl.[7] ..... A46B 9/04; A46B 15/00

(52) U.S. Cl. ..... 15/105; 15/167.1; 433/216; 446/484

(58) Field of Search ..... 15/105, 167.1, 15/167.2; 433/216; 446/485, 484, 472

(56) References Cited

U.S. PATENT DOCUMENTS 2,981,963 A * 5/1961 Peilet et al. ..... 15/105
3,104,056 A * 9/1963 Cross ..... 15/105
4,253,212 A * 3/1981 Fujita ..... 15/167.1
5,044,037 A * 9/1991 Brown ..... 15/105
5,133,102 A * 7/1992 Sakuma ..... 15/167.1
5,134,743 A * 8/1992 Hukuba ..... 15/105
5,485,646 A * 1/1996 Merritt ..... 15/105
5,673,451 A * 10/1997 Moore et al. ..... 15/105
5,924,159 A * 7/1999 Haitin ..... 15/105
6,106,294 A * 8/2000 Daniel ..... 15/105
6,154,912 A * 12/2000 Li ..... 15/105

* cited by examiner

*Primary Examiner*—Gary K. Graham

(57) ABSTRACT

The present invention comprises a toothbrush supporting brushing behavior reinforcement means. A simple motion sensing means is electrically connected to a brushing logic means, which determines generalized brushing action of a user preferably a child. After the logic requirements of motion sensing are complete, the logic means directs a digital output display means to output to a small LCD screen or speaker a visual and/or audible reward to the user, preferably in the form of an enjoyable game or congratulatory message.

13 Claims, 5 Drawing Sheets

FIGURE 10
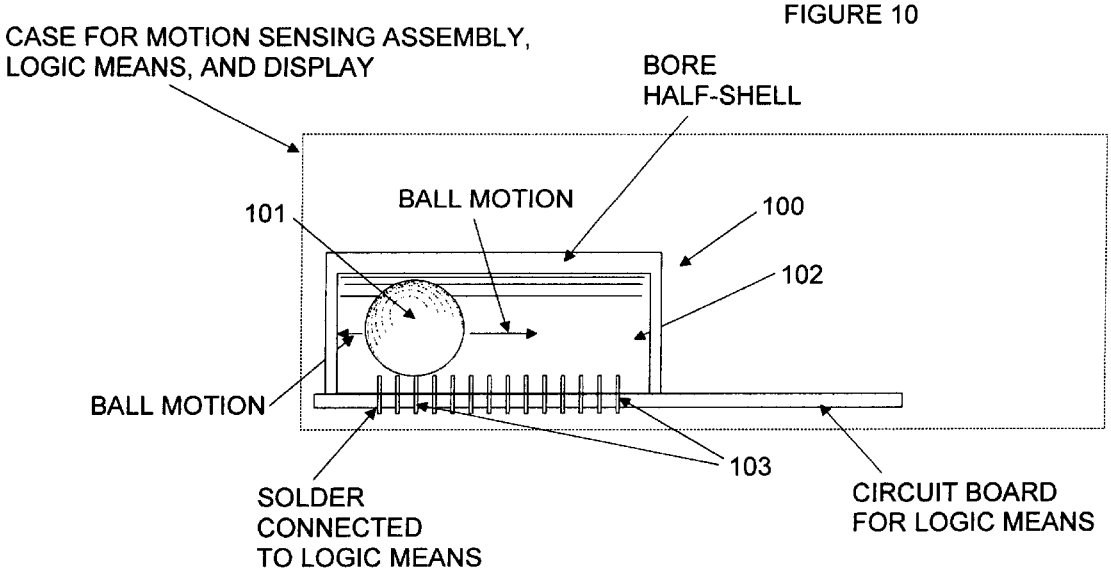
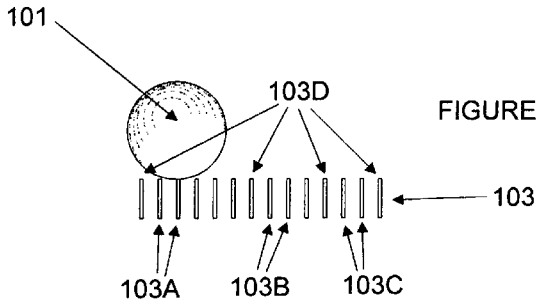
FIGURE 11

LOW COST BRUSHING BEHAVIOR REINFORCEMENT TOOTHBRUSH

FIELD AND BACKGROUND OF THE INVENTION

The present invention relates to a toothbrush having the capability of reinforcing brushing behavior.

Encouraging young and sometimes older persons to brush their teeth at low cost results in a high value benefit to the individual. The present art for low cost LCD and other displays as well as low cost audio outputs places within economic reach such devices for incorporation into a toothbrush for interactive encouragement and detection of failure to begin or complete brushing.

SUMMARY OF THE INVENTION

The present invention comprises a toothbrush supporting brushing behavior reinforcement means. A simple motion sensing means is electrically connected to a brushing logic means, which determines generalized brushing action of a user preferably a child. After the logic requirements of motion sensing are complete, the logic means directs a digital output display means to output to a small LCD screen or speaker a visual and/or audible reward to the user, preferably in the form of an enjoyable game or congratulatory message. The present invention also comprises a method of commercial promotion in which the invention toothbrush is provided in its visual or audible display a promoted character voice or shape for the game or congratulatory message, such that free or below cost giveaway by a fast food or similar enterprise potentially increases its business.

BRIEF DESCRIPTION OF THE DRAWINGS

FIG. 10 is a cut-away side view of half-shell with a bore mounted on a circuit board for an alternate embodiment of the motion sensing assembly.

FIG. 11 is a side view of only the contacts and ball of the motion sensing assembly identifying game switches or game switch zones.

DETAILED DESCRIPTION OF THE INVENTION

Figure 1:
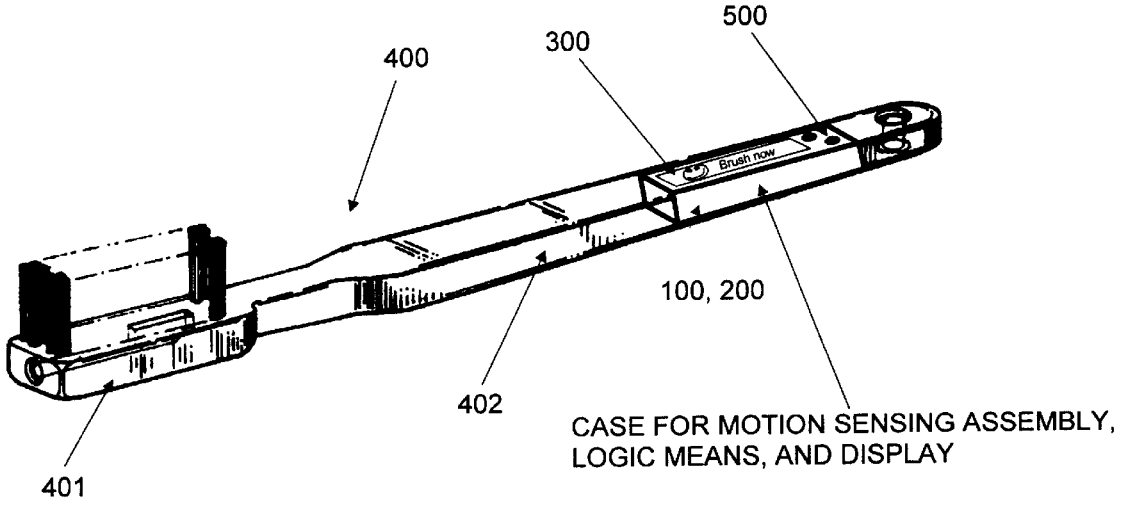
FIG. 1 is a perspective view of the invention toothbrush in one embodiment.

FIG. 1 shows a toothbrush 400 with a conventional head 401 and handle 402. The invention motion sensing means

100, logic means 200 and display means 300 are contained in this specific example in a small handle-supported case as shown in FIG. 1, which handle support case comprises buttons 500 communicating with logic means 200 for input and/or game play as described below.

Figure 2:
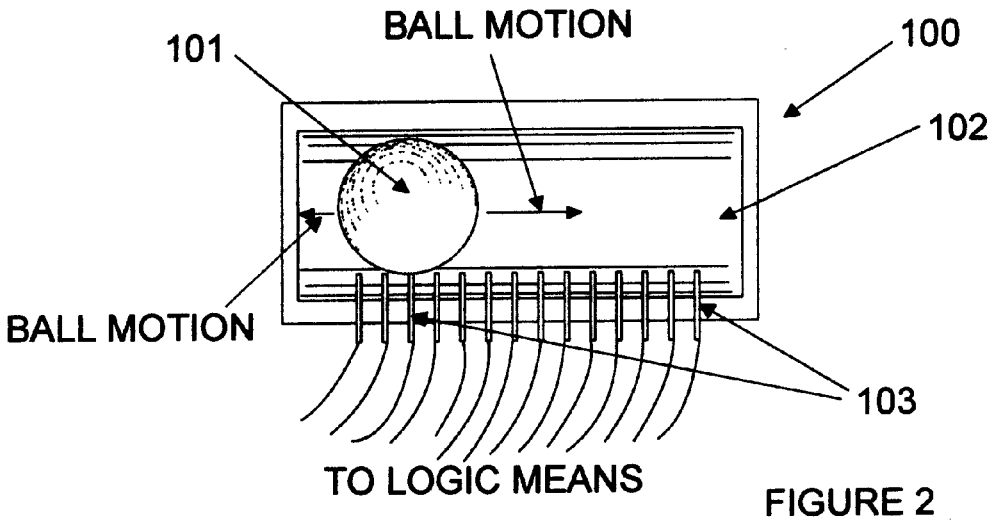
FIGS. 2 is cut-away side view of the cylindrical bore in a shell for a motion sensing means of the invention toothbrush.

The present invention comprises a toothbrush with a handle sufficient to support and preferably at least partially encase motion sensing means 100, logic means 200 and a digital output display means 300. Motion sensing means 100 are shown in FIG. 2, whereby a metallic or metallic surfaced ball 101 is located in a non-conductive bore 102. The bore has intruding into it electrical contacts 103, the contacts preferably comprising a simple wire end with sufficient stiffness that it will not bend upon ball contact as described below. Contacts 103 and ball 101 are arranged so that the ball may roll relatively freely across the contacts so that the ball contacts only one or two contacts at any time. although it is preferable that the bore, contacts and ball are arranged such that ball 101 is in contact with at least one contact at all times. Contacts 103 are preferably separated by about 0.012 inches. When bore 102 is oriented so that contacts 103 are located above ball 101 respective to gravity, it is intended that normal vigorous toothbrushing motion will cause the ball to bump into two contacts in the "ceiling" of bore 102.

Bore 102 is preferably aligned with the longitudinal axis of the toothbrush handle, although the objects of the present invention may at least in part be achieved if bore 102 is aligned at an angle or perpendicular to that axis. It is intended that the relationship of the ball within the bore permit the ball to move into and away from contact with two contacts from time to time upon significant motion of the toothbrush. Each contact and breaking of contact of ball 101 with two contacts 103 respectively completes and breaks an electrical circuit electrically connected with logic means 200. Motion sensing according the invention is determined by the logic means 200 by sensing within a clock period a minimum number of electrical contact completions and breaks, which means are provided with a simple clock and counting means therein. As a simple example of the invention motion sensing method, a user may pick up the toothbrush and apply toothpaste or otherwise manipulate the toothbrush, causing ball 101 to make or break electrical connection with contacts 103, say 10 times in 20 seconds, by that motion. However, logic means 200 will contain programming sufficient to compare the number of makes/breaks over a 20 second interval so that brushing motion detection is not recognized until the number of makes/breaks is greater than 10.

The orientation of ball 101 in bore 102 provides relatively free, undamped movement therein. In an alternate embodiment, damping fluid such as a non-conductive oil may fill bore 102 thereby reducing makes/breaks to the logic means 200 by making simple, non-vigorous brushing motion of the toothbrush.

Logic means 200 comprises circuitry, memory and/or microprocessors with a real time clock for correlating brush strokes and time, and means 200 also goes to sleep and/or directs an output to display means 300 at 30 to 60 seconds after logic means ceases to sense makes or breaks from means 100. At the sensing a first make or break from means 100, logic means 200 wakes up and receives in an undifferentiated manner the make/break information from ball 101 and contacts 103. Logic means 200 simply counts makes and breaks in a predetermined time period and compares that number with a predetermined number of makes/breaks. If the number of actual makes/breaks exceeds the predetermined number, logic means 200 directs output to display means 300 in a manner to indicate to the user that a desired behavior is achieved or not achieved.

The invention assembly is powered by a small battery and designed to meet low power requirements of the components for a relatively long period of time.

Display means 300 are provided with an LCD display with or without audible output to the user. The visual and/or audible output is a critical part of the invention. Optional outputs are shown in the figures.

Figure 3:
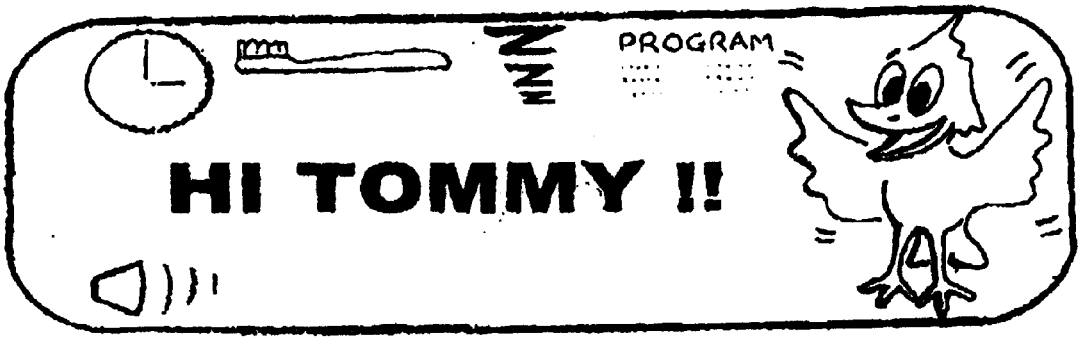
FIG. 3 is an exemplary LCD display of the display means of the invention toothbrush.
Figure 4:
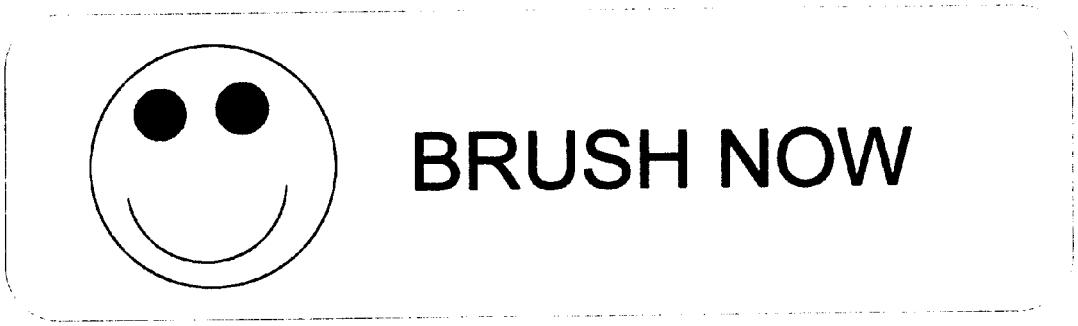
FIG. 4 is a "sleep" mode display for an exemplary LCD display.

FIG. 3 shows a display with means for identifying sleep, wakeup, name, sound and time modes. FIG. 4 shows another embodiment of the display for a sleep mode where after lack of makes/breaks from means 100 at about 2 minutes, means 200 causes the means 300 to present an initial encouragement display. The BRUSH NOW/PLAY LATER encourages the user to begin brushing with the inducement of a game play later.

Figure 5:
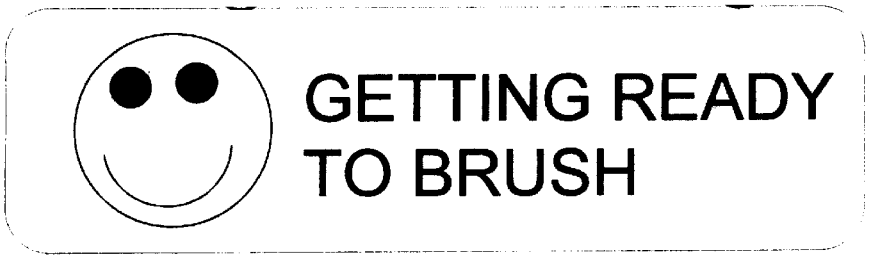
FIG. 5 is an initiation mode display for the LCD display of FIG. 4.

FIG. 5 is an initiation mode display for the LCD display of FIG. 4. This mode is the period of time in which the user first picks up the toothbrush and manipulates it to apply toothpaste and other preparations. In a hygienists office, the hygienist may prepare the toothbrush. The display GETTING READY TO BRUSH display disappears and is replaced with the display of FIG. 6 for a brushing period mode display of BRUSHING TO PLAY/PART 1 when the frequency of the make/breaks of means 100 exceeds a certain minimum.

Figure 6:
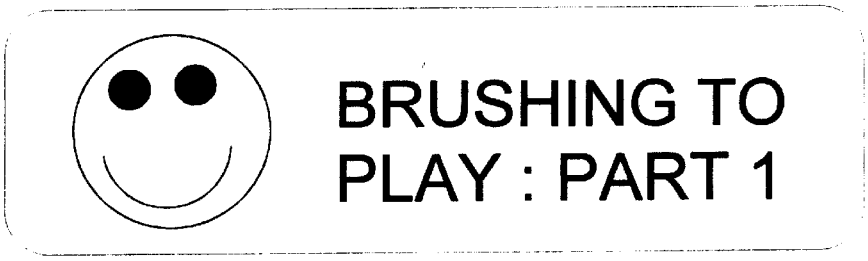
FIG. 6 is a brushing period mode display for the LCD display of FIG. 4.

In one embodiment of the invention, the PART 1 display of FIG. 6 indicates that the user must brush for a predetermined period and then stop brushing, whereupon the game playing mode of FIG. 10 is accessible to the user. In another embodiment of the invention, that PART 1 display indicates that the user must stop brushing for a short period of time (requiring brushing in a tooth zone such as top teeth or a quadrant) and then must begin brushing again, whereupon the display changes to PART 2. Alternatively, a PART 1 /2 may show alternate highlighting of the "1" or "2" depending on the zone being brushed.

Figure 7:
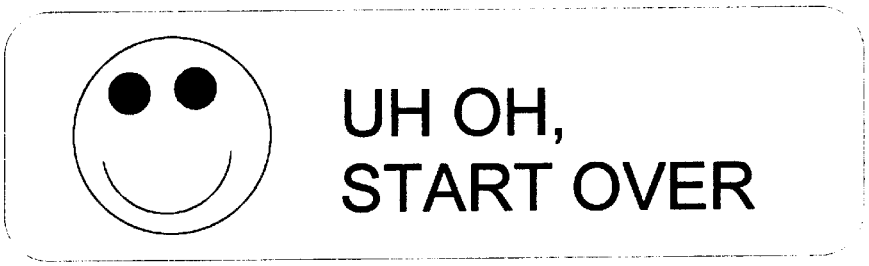
FIG. 7 is a brushing failure mode display for the LCD display of FIG. 4.

FIG. 7 is a brushing failure mode display UH OH, START OVER wherein means 200 has detected that brushing motion sensing has stopped for been reduced in minimum frequency. Means 200 provides that once minimum make/break frequency is re-established, the zone completion modes of the previous paragraph are reset for completion.

Figure 8:
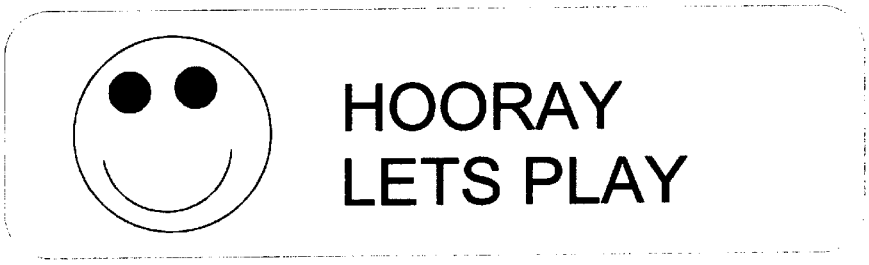
FIG. 8 is a brushing overall success mode display for the LCD display of FIG. 4.

FIG. 8 is a brushing overall success mode display of HOORAY LET'S PLAY for the LCD display of FIG. 4. This mode is displayed for a short period of time before the display of FIG. 9 is presented.

Figure 9:
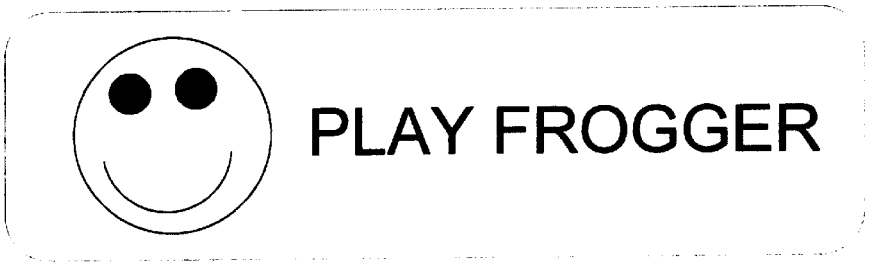
FIG. 9 is a brushing success game mode display for the LCD display of FIG. 4.

FIG. 9 is a brushing success game mode display for the LCD display of FIG. 4. This portion of the programming of means 200 comprises a simple game such as are common for such small screens as in the present invention. Such games comprise the electronic "pet" care games, making the pet survival at least partly dependent on successful toothbrushing, or skill games such as "Frogger" or other such games. The user is permitted to play the game for a predetermined period of time or skill level, whereupon the display returns to that of FIG. 4, the programming having been reset to begin the invention process again.

In an alternate embodiment of the present invention, the sleep mode indication on the display and in the reward programming will remain in effect until the count frequency of the make/breaks exceeds a brushing count frequency, such that the display will change only after brushing count frequency for the toothbrush is achieved. With this embodiment, the user only views a sleep mode display, a brushing mode display, and a reward display for a "success" animation, sound or game as a reward for completion of brushing.

The present reward display for at the FIG. 9 level can be configured with a currently popular cartoon or movie figure as a promotional item, making this low cost toothbrush an attractive give-away item for fast food and other such businesses. Thus, the present invention comprises a method for promotional give-aways or sales to improve business throughput of a fast food restaurant or other such business.

FIG. 10 is a cut-away side view of a half-cylinder fixed to a top side of a circuit board on which may be mounted the logic means components. It is preferred in this embodiment that the arrows indicating ball motion are substantially parallel to the axis of the toothbrush so that axial back and forth motion of the toothbrush will cause the ball 101 to roll back and forth. Contacts 103 penetrate the circuit board and are solder connected with the logic means on the bottom side of the circuit board. In an alternate embodiment of the contacts 103 and ball 101 relationship for sensing counts, FIG. 11 shows only contacts 103 and ball 101, although the shell and bore and logic means connections of the other Figures are implied. In the FIG. 11 embodiment, left zone 103A, center zone 103B and right zone 103C each comprises only 2 contacts, although more than two contacts may be adjacently a part of each such zone. During game mode operation, the logic means senses differentiates counts from each of left zone 103A, center zone 103B and right zone 103C as switches for game playing, eliminating buttons 500 from the present invention entirely and permitting watertight enclosure of the motion sensing assembly, the logic means, display and battery powering the invention within the case shown in FIG. 1.

Figure 12:
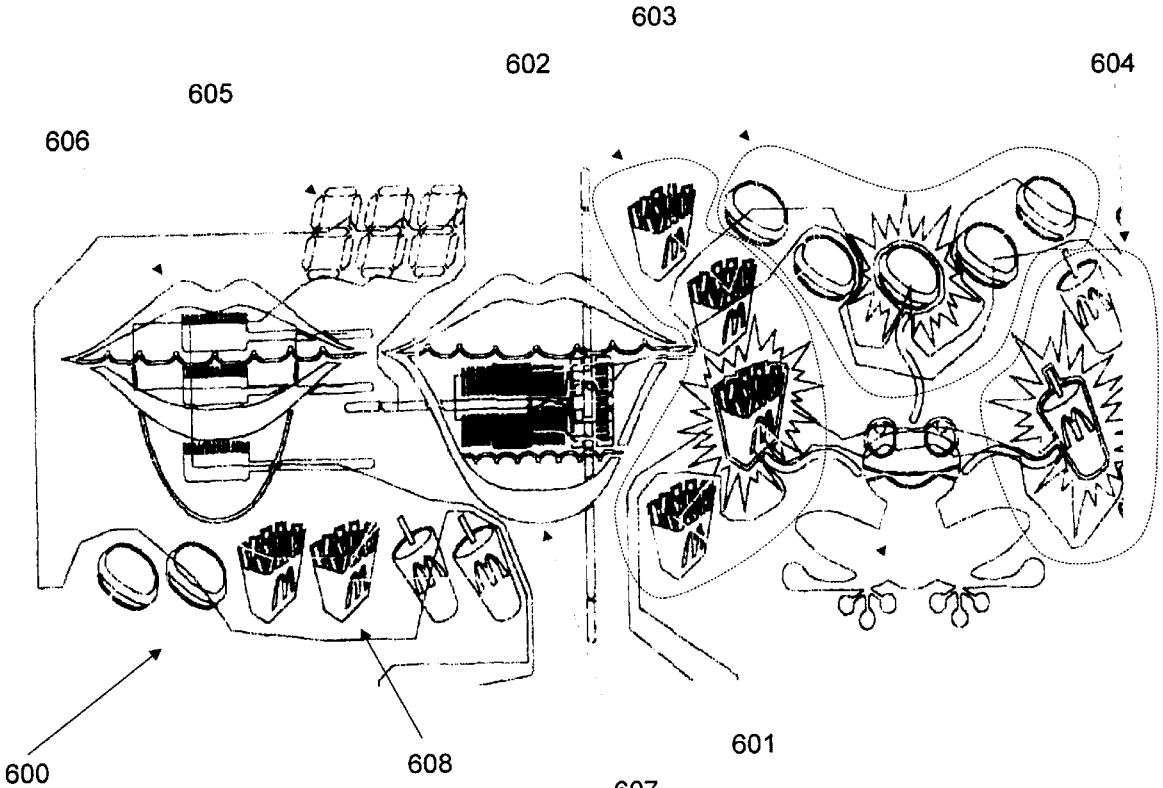
FIG. 12 is an alternate display screen for the invention showing brushing instruction and game aspects of the invention.

As shown in FIG. 12 display for the invention, left zone 103A contacts in the game mode connected by the ball register cause the logic means to register as a left zone 602 action, center zone 103B contacts in the game mode connected by the ball register cause the logic means to register as a center zone 603 action and right zone 103C contacts in the game mode connected by the ball register cause the logic means to register as a right zone 604 action. The registry of the actions optionally causes a highlighting in the zones 602–604 and/or point accumulation in point display 605. The game of FIG. 12, as an example of the invention reward or game mode, comprises a frog or capture FIG. 601 having the ability to reach with its tongue to "capture" objects in the zones 602–604. The "capture" activity comprises the steps, say for left zone 602, of requiring the user to angle the toothbrush axis down to the left to cause a connection contact in zone 103A which thereby registers a count in the logic means for that zone which results in a highlighted object in zone 602 and/or a point increase in point display 605. Similarly, the user may angle the toothbrush axis downward to the right to cause connection in zone 103C resulting in a count causing a display in zone 604 and/or an increase in points in point display 605. The traverse of ball 101 back and forth across the contacts in FIG. 11 causes a count to registered for zone 103B, resulting in a display highlight in zone 603.

The number of zones of game or reward mode-active contacts in FIG. 11 may be reduced to one or be increased to more than three depending on the game actions required in the game or reward mode. The game presented in FIG. 12 is exemplary of one of may skill games that may be included in the logic means for presentation on the display 300. For example, Frogger is a game requiring only a single game mode-active zone for moving a frog across a river with some obstacles.

Contacts 103D in FIG. 11 are optional as separation or inactive contacts during the game mode, whereby additional activity is desired to move the ball 101 from one game mode-active zone to another. The number of such contacts 1 03D creating such distance may be varied depending on the desired action for the game mode.

In another embodiment of the invention, the sleep mode of the logic means may be replaced with an off mode, such that the display is blank and essentially no power is delivered thereto when the number of counts is zero for a preset period of time. In this embodiment, the first count causes the logic means to show a display indicating the brushing should be taking place, i.e., the brushing mode. In the brushing mode, the logic means monitors in some form the motion sensing counts to determine if brushing is taking place in a desired manner. Such monitoring may be in one of several forms, such as (1) the number of first or actual counts within a short time period is compared to a preset number of counts for that time period (for example, 3 counts in 5 seconds), (2) the number of first or actual counts within a full time period for desired brushing activity of the entire mouth is compared to a preset number of counts for that activity (for example, 100 counts in 2 minutes), (3) the number of first or actual counts within a time period for a mouth section (top and bottom teeth, teeth quadrants, and/or tongue) is compared to a preset number of counts for that mount section (for example, 3 counts in 5 seconds), (4) the number of first or actual counts occur within a preset time period of each other, or (5) other actual count measurement methods to determine compliance with desired brushing motion. If such monitoring indicates the desired brushing motion has taken place, the logic means causes a screen display indicating that the user should move to the next mouth section for another portion of the brushing mode or that all the desired brushing is accomplished and a game may begin.

In FIG. 12, display 606 is presented in the display 300 during a portion of the brushing mode when it is desired that the user brush the teeth mouth-side surfaces up and down with teeth together. Display 606 alternately presents another view in the display 300 during a portion of the brushing mode when it is desired that the user brush the tongue, indicated by the brush outline on the tongue outline. Display 607 is presented in the display 300 during a portion of the brushing mode when it is desired that the user brush the teeth with teeth apart, and may be used to indicate that the user brush the buccal cavity and mouth side tooth surfaces in quadrants or other such divisions of that portion of the brushing mode.

I claim:

1. A toothbrush for reinforcing brushing behavior comprising:

(a) the toothbrush supporting a motion sensing assembly, a logic means for receiving a motion sensing assembly input and outputting a display output, and a display;

(b) the motion sensing assembly comprising a shell having a bore, closely associated electrical contacts in the bore and a metallic ball capable of rolling within the bore across the contacts; and (c) the logic means is electrically connected with the contacts such that adjacent contacts comprise an uncompleted circuit which closes on connection by the ball, whereby the logic means records such circuit completions as counts.

2. The toothbrush of claim 1 wherein the logic means are adapted such that when counts are zero for period of time, a sleep or off mode is initiated.

3. The toothbrush of claim 2 wherein the logic means are adapted to detect a count in the sleep or off mode thereby causing the logic means to initiate a brushing mode and the display is caused to indicate a brushing mode is initiated.

4. The toothbrush of claim 3 wherein the logic means are adapted to monitor counts in the brushing mode to determine if a desired brushing motion is taking place.

5. The toothbrush of claim 4 wherein the logic means are adapted to reset the brushing mode if the monitored counts indicate the desired brushing motion is not achieved.

6. The toothbrush of claim 4 wherein the logic means are adapted such that the brushing mode is divided into portions, whereby in each portion the logic means causes the display to show a portion of the mouth to indicate to the user that a toothbrush motion should be used or a portion of the mouth should be brushed.

7. The toothbrush of claim 6 wherein the logic means are adapted to reset the portion of brushing if the monitored counts indicate desired brushing motion is not achieved.

8. The toothbrush of claim 2 wherein the logic means are adapted to, at the first count after the sleep or off mode is ended, initiate an initiation mode wherein the monitored counts do not indicate that desired brushing motion is taking place and the display is caused to indicate an initiation mode, whereby if desired brushing motion is not monitored within an initiation mode period, the display is cause to return to the sleep or off mode.

9. The toothbrush of claim 1 wherein the logic means are adapted to monitor counts in the brushing mode for comparison to a value preset to indicate success for a desired brushing motion, thereby initiating a reward mode whereby the logic means causes the display to show a congratulatory message or starting an interactive game.

10. The toothbrush of claim 9 wherein the logic means are adapted such that in an interactive game in the reward mode fewer than all the contacts but more than two contacts are active for registering counts, such fewer contacts constituting a game mode active zone.

11. The toothbrush of claim 10 wherein the logic means are adapted to differentiate between counts from more than one game mode-active zone.

12. The toothbrush of claim 11 wherein the logic means are adapted to differentiate between counts from left center and right game mode-active zones, such that contacts for those zones are located sequentially along the row of contacts.

13. The toothbrush of claim 9 wherein the display in the brushing mode comprises a popular cartoon or movie image or character to further induce the user to finish brushing motion sufficient to initiate the reward mode.

* * * * *